US005180233A

United States Patent [19]

Kim et al.

[11] Patent Number: 5,180,233

[45] Date of Patent: Jan. 19, 1993

[54] THERMAL TRANSFER PRINTER

[75] Inventors: Jong-woo Kim; Ki-sun Jang, both of Suwon, Rep. of Korea

[73] Assignee: Samsung Electronics Co., Ltd., Suwon, Rep. of Korea

[21] Appl. No.: 711,979

[22] Filed: Jun. 7, 1991

[30] Foreign Application Priority Data

Jan. 31, 1991 [KR] Rep. of Korea ..... 91-1868

[51] Int. Cl.[5] ..... B41J 2/32

[52] U.S. Cl. ..... 400/120; 400/629; 400/635

[58] Field of Search ..... 400/120, 629, 635

[56] References Cited

FOREIGN PATENT DOCUMENTS 0225582 6/1987 European Pat. Off. ..... 400/120

0185665 10/1984 Japan ..... 400/120

0201272 9/1987 Japan ..... 400/120

*Primary Examiner*—Edgar S. Burr

*Assistant Examiner*—Lynn D. Hendrickson

*Attorney, Agent, or Firm*—Robert E. Bushnell

[57] ABSTRACT

A thermal transfer printer having a simplified structure and an improved printing speed, includes a paper supply section including a plurality of roller guides for guiding sheets of paper from a paper tray, a printing section including a platen drum and a thermal print head, for printing a picture onto paper guided along the platen drum, and a paper discharging section including a plurality of roller guides, for discharging the printed paper. The printing section includes a platen drum, one or more guide drums and a pair of roller guides, forming a closed loop around the drums on which sheets of paper are carried.

9 Claims, 3 Drawing Sheets

THERMAL TRANSFER PRINTER

BACKGROUND OF THE INVENTION

The present invention relates to a thermal transfer printer, and particularly to a color thermal transfer printer having a simplified structure and an improved printing speed.

A color thermal transfer printer prints an electrical image onto a sheet of paper, which is the so-called video printer. In such color thermal transfer printers, certain color dyes coated on a film ribbon are sublimed into a predetermined pattern by a thermal print head, and the sublimed dyes are transferred onto paper. Then, three color dyes such as yellow, magenta and cyan are overlapped according to color-separated picture units to produce a full color image.

FIG. 1 illustrates a conventional color thermal transfer printer.

The printer is constructed in such a manner that thermal printing of an image is carried out while a sheet of paper 2, the printing medium is rolled around the periphery of a platen drum 1 of a large diameter, wherein a thermal print head 3 pressed against the periphery of platen drum 1 is installed on the upper part of the platen drum 1 of a large diameter to be revolvable by an extra support, a color ribbon taken out of cartridge 4 is positioned between thermal print head 3 and platen drum 1, and a pair of guide rollers 6 for guiding the sheet of paper 2 to the platen drum 1 is provided near the platen drum 1.

The conventional thermal transfer printer as constructed above is disadvantageous in that the planten drum 1 needs to be of a very large diameter since the sheet of paper 2, which is a specific length, must be entirely rolled around the periphery of the platen drum 1 without the sheets ends overlapping each other. Thus, the large diameter of the platen drum increases the overall dimensions of the printer, particularly its height.

To improve this structural disadvantage, a thermal transfer printer as shown in FIG. 2 has been recently developed.

The newly developed thermal transfer printer, contrary to the aforesaid conventional printer, is constructed in such a manner that a sheet of paper is not rolled around a platen drum. That is, the size of the platen drum 1' which the thermal print head contacts, is reduced to a smaller diameter so that the whole sheet can no longer be rolled around the platen drum as before. Instead, the sheet of paper 2' passes through the platen drum 1' while in contact with the drum. A carrier conveys the sheet in a slow, progressive manner forward and backward for a predetermined and sufficient distance. The carrier includes a clamp 7 for clamping and releasing the front edge of the sheet of paper 2' by an operating device, a guide rod 7' for guiding the clamp 7, and an extra driver for forward and backward movement of the clamp 7.

Further, the conventional thermal transfer printer requires a very long paper supply section to provide a sufficient paper-carrying distance, which includes paper guiding plate 9 along curved path P starting from the upper rear of paper tray 8, and a plurality of paper guiding rollers 10 located along path P. This particular conventional structure where papers are supplied via curved path P in the opposite direction of platen drum 1', requires a very complicated power transmission mechanism. In addition, the conventional printer takes an overly long time to carry the paper through a long paper-carrying distance and to print while moving the sheets of paper forward and backward.

SUMMARY OF THE INVENTION

Therefore, it is the object of the present invention to provide the thermal transfer printer with a reduced external size, a simplified power transmission mechanism, and a remarkably shortened printing time.

To accomplish the object, the thermal transfer printer according to the present invention includes:

a paper supply section including a plurality of roller guides for guiding the paper from the paper tray;

a printing section including a platen drum for supporting the paper while printing, a thermal print head attaching to or detaching from the platen drum, one or more paper guiding drums, located near the platen drum for forming a closed loop together with the platen drum for guiding the sheets of paper along the periphery of the loop, and a plurality of roller guides, located around the drums, for guiding the paper's movement through the closed loop, wherein the printing of a color picture is performed while paper is conveyed along the closed loop provided on the periphery of the drums; and a paper discharging section including a plurality of roller guides to discharge the printed paper.

Guide plates for guiding the sheets of paper are formed at proper intervals above the closed loop on the periphery of the drums of the printing section. Also provided are a paper inserting section into which the sheets of paper from the paper supply section is inserted, and a paper extracting section from which the printed sheets of paper are drawn out.

It is more desirable that one or more guide belts around the every guide drum except the platen drum be rolled to allow the sheets of paper to move more smoothly along the closed loop around the drums.

DETAILED DESCRIPTION OF THE INVENTION

Figure 1:
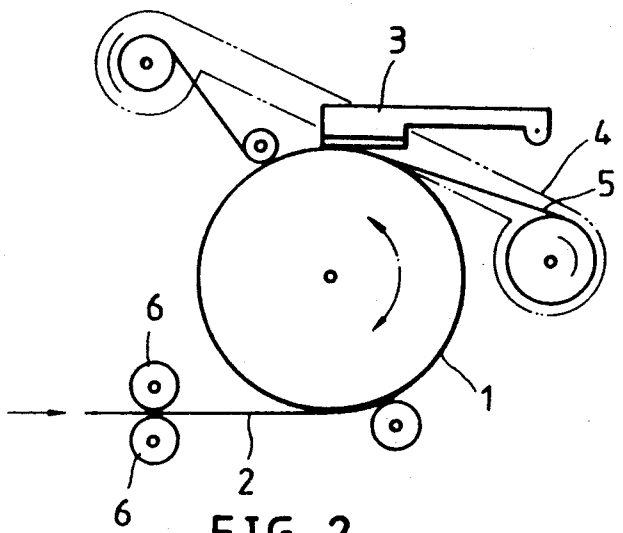
FIG. 1 is a schematic side view showing the major parts extracted from a conventional thermal transfer printer.
Figure 2:
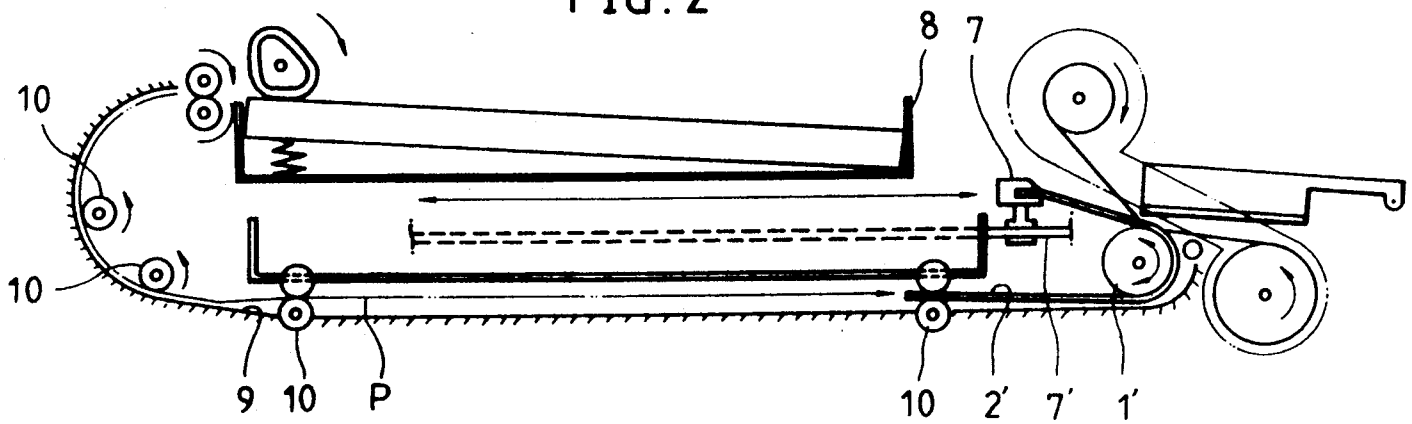
FIG. 2 is a schematic side view showing the major parts extracted from another conventional thermal transfer printer.
Figure 3:
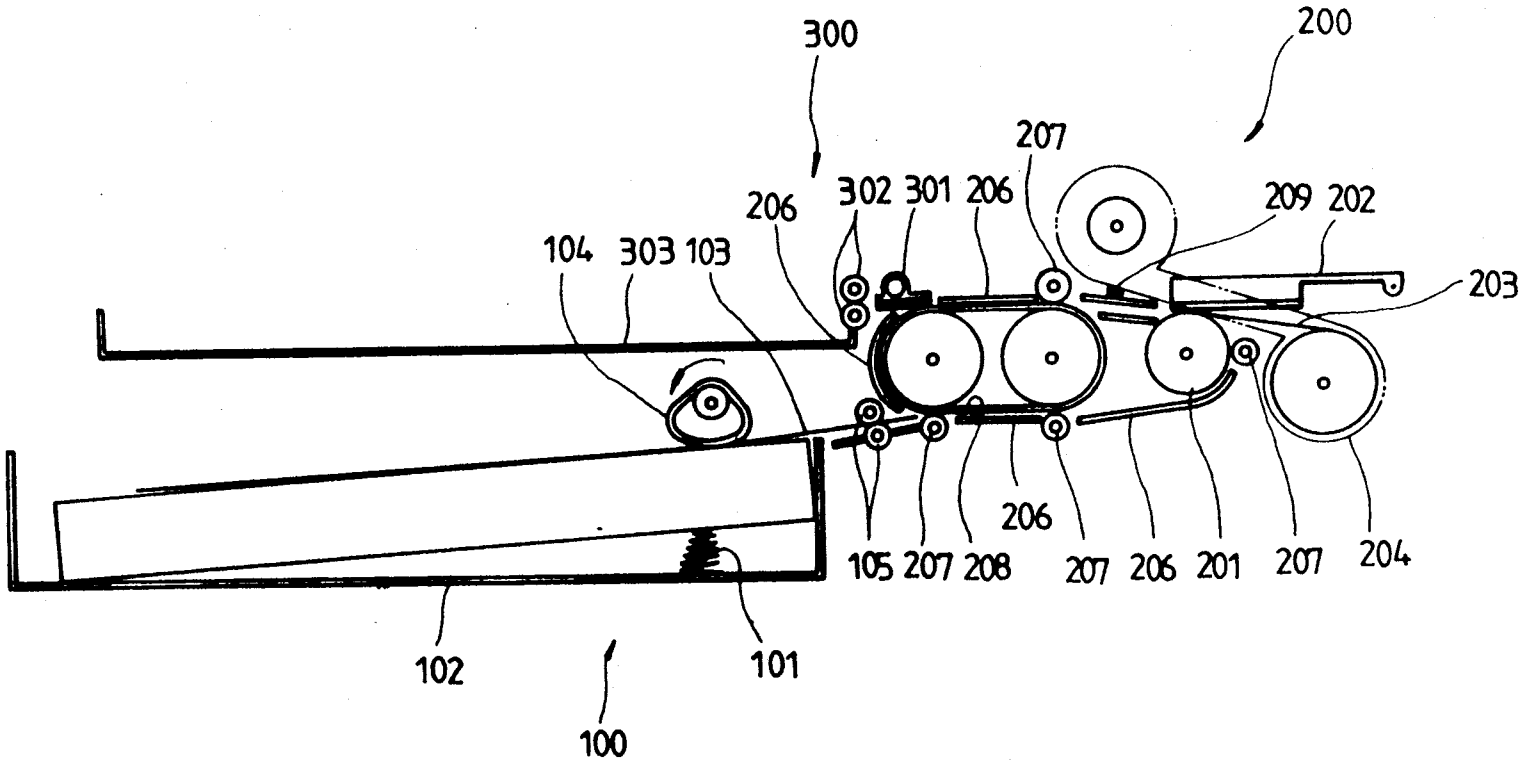
FIG. 3 is a schematic side view of the thermal transfer printer according to the present invention.
Figure 4:
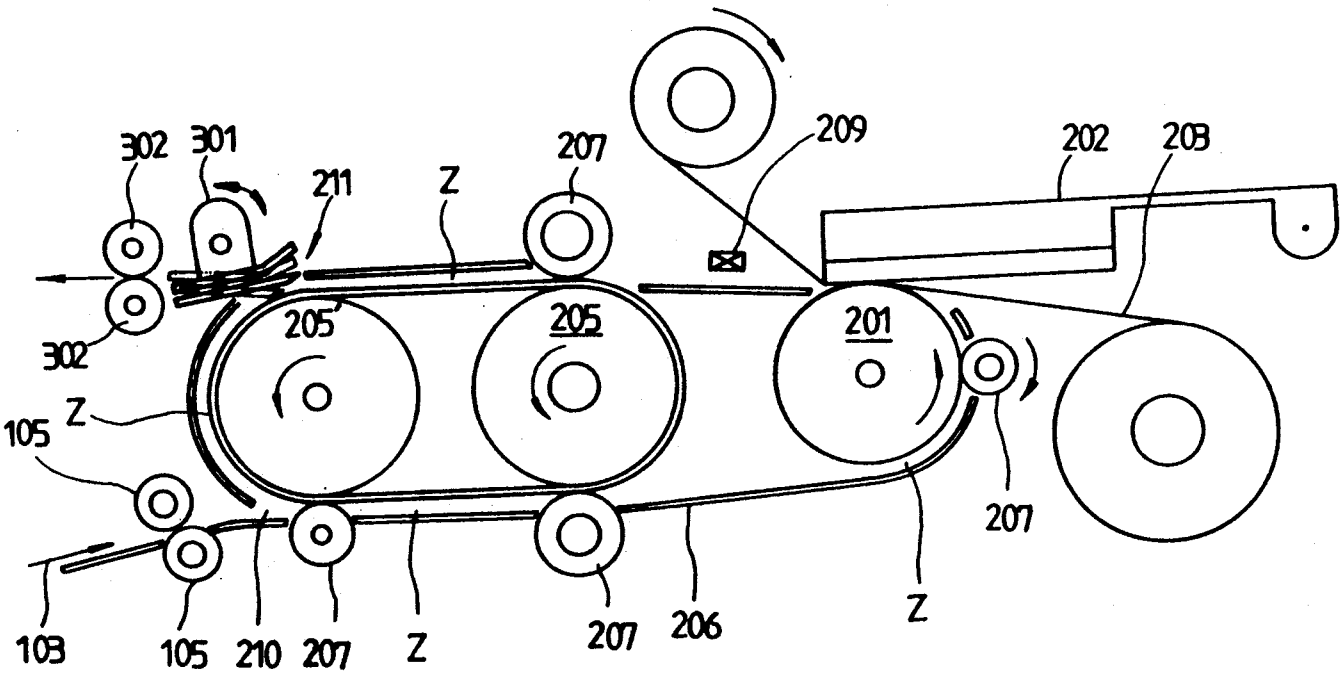
FIG. 4 is a schematic side view showing the major parts extracted from the thermal transfer printer of the present invention shown in FIG. 3.

Referring to FIGS. 3 and 4, the thermal transfer printer of the present invention includes paper supply section 100 from which sheets of paper are supplied, printing section 200 in which pictures are printed on a paper, and paper discharging section 300 from which the printed paper is discharged.

The paper supply section 100 includes paper tray 102 having paper lifter 101, cam 104, which draws the sheets of paper out from the tray 102 one sheet at a time, and roller guides 105 for guiding the drawn paper 103 into the printing section 200.

The printing section 200 includes platen drum 201 of a small diameter, thermal print head 202, ribbon 203, cartridge 204 for the ribbon, and a pair of guide drums 205 and 205'. The platen drum 201 and two guide drums 205 and 205' are positioned on the same plane, and guide plates 206 are provided around the drums to guide paper transfer. A plurality of capstans and/or pinch rollers 207 of a small diameter is provided between the guiding plates 206. The two guide drums 205 and 205' are rolled by a conveyor belt 208 and are ganged together. Further, paper detecting sensor 209 is located between the platen drum 201 and guide drum 205.

Meanwhile, on the periphery of the drums 201, 205 and 205', and between the paper carrying closed loop Z, there are provided paper inserting section 210 through which sheets of paper from the paper supply section 100 are inserted, and paper extracting section 211 from which the printed paper is drawn out and into paper discharging section 300.

A paper discharging section 300, provided neighboring the paper extracting section 211, includes movable extracting guide 301, located near the paper extracting section 211, for selectively guiding sheets of paper moving along the closed loop Z, paper discharging rollers 302 for discharging the sheets of paper guided by the movable extracting guide 301, and receiving tray 303 for storing the discharged papers.

The operation of the thermal transfer printer according to the present invention is described below.

The paper 103 directed upward by lifter 101 of tray 102 is drawn out by cam 104, and the paper is inserted into inserting section 210 of the printing section 200 by guide roller guide 105. The paper moves along the closed loop Z including two guide drums 205 and 205', platen drum 201, and guiding plates 206 embracing the drums, and is conveyed counter-clockwise as viewed to pass around platen drum 201 to be detected by sensor 209.

Meanwhile, printing is performed by the thermal print head 202 and ribbon 203 according to a conventional method. The front edge of sheet coming off of platen drum 201 and following the U-shaped path at the other end of the closed loop Z of guide drums 205 and 205', again approaches platen drum 201. At this time, one color-separated image has already been completed.

Then, the sheet again passes around platen drum 201 and by sensor 209 to print other color-separated image, and the now twice-printed paper again circles the loop and approaches platen drum 201, at which time the final color-separated image is printed.

As described above, a full color image is produced after three circulation of the closed loop Z. When the sheet of paper, on which a full color image is printed, approaches the paper extracting section 211 during the third circulation of the closed loop Z, the extracting lever 301 operates to both allow the paper to exit loop Z through paper extracting section 211 and to move it through paper discharging rollers 302. The roller guides 302 direct the sheet into paper discharging tray 303.

In the above operational description, printing process is not described in detail since it follows the conventional method.

The feature of the thermal transfer printer of the present invention is that the diameter of a platen drum is small, and that sheets of paper are carried through a closed loop including a plurality of drums during printing. The closed loop requiring closely arranged drums and juxta positioned roller guides greatly simplifies a power transmission structure over the conventional one. Furthermore, the present invention has the advantage of the printing speed being very quick due to an operational characteristic whereby sheets of paper are sequentially carried in one direction through a closed loop.

While the invention has been particularly shown and described with reference to preferred embodiments thereof, it will be understood by those skilled in the art that various changes in form and details may be made therein without departing from the spirit and scope of the invention as defined by appended claims.

What is claimed is:

1. A thermal transfer printer comprising:

a paper supply section including a plurality of roller guides for guiding a paper from a paper tray;

a thermal print head;

a printing section including a platen drum for supporting said paper while printing of a color picture is performed by said thermal print head, said thermal print head being pressed against said platen drum, an endless conveying belt spaced-apart from said platen drum, two or more paper guiding drums being connected together by said endless conveying belt, said guiding drums rotating said endless conveying belt independently of said platen drum, and being spaced-apart and arranged in parallel to said platen drum, said two or more paper guiding drums and said platen drum forming a closed loop for guiding said paper along the periphery of said closed loop, and a plurality of roller guides, provided in complement to said paper guiding drums for guiding movement of said paper through said closed loop; and a paper discharging section including a plurality of roller guides for discharging said printed sheets of paper.

2. A thermal transfer printer as claimed in claim 1, further comprising guide plates disposed adjacent to said conveying endless belt in between said plurality of roller guides for guiding said paper to a contact point of said platen drum and said thermal print head for performance of said color printing picture.

3. A thermal transfer printer as claimed in claim 2, wherein said platen and guide drums are on the same axis.

4. A thermal transfer printer as claimed in claim 1, wherein said platen and guide drums are on the same axis.

5. A thermal transfer printer, comprising:

a thermal print head for generating heat in response to color signals and for printing color symbols representative of said color signals onto a printable medium;

a platen drum coupled in complement to said thermal print head for receiving said printable medium to provide rotation for feeding said printable medium through said thermal print head, and for providing support to said printable medium during the printing of said color symbols representative of said color signals by said thermal print head;

means for supplying said printable medium; and conveyor means for conveying said printable medium to said platen drum and said thermal print head, said conveyor means having an endless belt, a plurality of guide drums for rotating said endless belt independently of said platen drum, each of said plurality of guide drums being spaced-apart by a first distance and connected together by said endless belt, for conveying said printable medium to said plate drum and said thermal print head by providing synchronous rotation of said plurality of guide drums with respect to one another, said endless belt being spaced-apart from and positioned at a second distance from said platen drum and said thermal print head forming a conveying path.

6. The thermal transfer printer as claimed in claim 5, wherein said conveyor means further comprises:

a pair of complementary roller guides for receiving said printable medium;

at least one pair of guiding plates positioned against each other, within said first distance between the spaced-apart guide drums, and between said endless belt and said platen drum for guiding said printable medium to said platen drum and said thermal print head; and a plurality of follower rollers coupled in complement to said endless belt and interposed between said plurality of pairs of guiding plates for affirming the conveyance of said printable medium to said platen drum and said thermal print head.

7. The thermal transfer printer as claimed in claim 5, further comprising a sensing means for sensing a presence of said printable medium to determine a number of complete revolutions of said printable medium along said conveying path of said conveyor means for completing the printing of color symbols representative of said color signals onto said printable medium, said sensor means generation a control signal upon the completion of said printing of color symbols representative of said color signals.

8. The thermal transfer printer as claimed in claim 7, further comprising an ejector means for ejecting said printable medium from said conveyor means, said ejector means having a movable extractor for ejecting said printable medium from said conveying path of said conveyor means in response to said control signal, and a pair of complementary rejecting roller guides for rejecting said printable medium from said movable extractor.

9. The thermal transfer printer as claimed in claim 5, wherein said platen drum and said plurality of guide drums rotate at an identical speed.

* * * * *